US010978828B2

(12) United States Patent
Ohtaka et al.

(10) Patent No.: US 10,978,828 B2
(45) Date of Patent: Apr. 13, 2021

(54) LEVER-TYPE CONNECTOR

(71) Applicant: Yazaki Corporation, Tokyo (JP)

(72) Inventors: Kazuto Ohtaka, Shizuoka (JP); Jun Ishikawa, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/849,008

(22) Filed: Apr. 15, 2020

(65) Prior Publication Data

US 2020/0335907 A1 Oct. 22, 2020

(30) Foreign Application Priority Data

Apr. 18, 2019 (JP) ..... JP2019-079206

(51) Int. Cl.
*H01R 13/629* (2006.01)
*H01R 13/631* (2006.01)

(52) U.S. Cl.
CPC ..... *H01R 13/62938* (2013.01); *H01R 13/631* (2013.01)

(58) Field of Classification Search
CPC ..... H01R 13/62938; H01R 13/631; H01R 13/62955; H01R 13/6295; H01R 13/641
USPC ..... 439/372, 157
See application file for complete search history.

(56) References Cited

U.S. PATENT DOCUMENTS 5,443,393 A * 8/1995 Okumura ..... H01R 13/62938 439/157
6,602,082 B2 * 8/2003 Nishide ..... H01R 13/62938 439/157
7,396,242 B2 * 7/2008 Dekoski ..... H01R 13/62955 439/157
7,419,390 B2 * 9/2008 Ohtaka ..... H01R 13/639 439/157
7,445,491 B2 * 11/2008 Fujii ..... H01R 13/62938 439/157
8,414,315 B2 * 4/2013 Dekoski ..... H01R 13/62944 439/157
2019/0081427 A1 3/2019 Ohtaka

FOREIGN PATENT DOCUMENTS

JP 2001-217033 A 8/2001

* cited by examiner

*Primary Examiner* — Hien D Vu
(74) *Attorney, Agent, or Firm* — Sughrue Mion, PLLC

(57) ABSTRACT

A lever-type connector includes a first connector, a second connector, and a lever. The lever is mounted on the first connector, and is configured to pull the first connector and the second connector to each other so as to engage the first connector and the second connector with each other by fitting, due to a rotational manipulation of the lever from a lever rotation start position to a lever rotation completion position. The first connector has a support shaft. The second connector has a cam groove, and a temporary locking projection disposed at an inlet of the cam groove. The lever has a bearing portion which is rotatably supported on the support shaft, and a cam boss which engages with the cam groove. A projection having a tapered portion is formed on an outer side of the cam boss in a connector removal direction.

3 Claims, 16 Drawing Sheets

LEVER-TYPE CONNECTOR

CROSS-REFERENCE TO RELATED APPLICATION

The present application is based on, and claims priority from Japanese Patent Application No. 2019-079206, filed on Apr. 18, 2019, the entire contents of which are incorporated herein by reference.

TECHNICAL FIELD

The disclosure relates to a lever-type connector.

BACKGROUND

A lever-type connector assembled to a vehicle body panel of an automobile is disclosed in JP 2001-217033 A, for example.

The lever-type connector includes a male connector, a female connector, and a lever. In the lever-type connector, a follower pin of the female connector is guided into an inlet of a cam groove formed in the lever, and the follower pin is moved along the cam groove by rotatably manipulating the lever so that the male connector and the female connector engage with each other by fitting.

SUMMARY

In the lever-type connector, a temporary setting state of the male connector and the female connector is maintained by locking the follower pin at the inlet of the cam groove. It is necessary to release the temporary setting state at the time of performing an operation such as a repair of a vehicle. However, the follower pin is locked perpendicular to the inlet of the cam groove and hence, there is a concern that a connector releasing force is increased so that a repair operation becomes difficult.

In a case where the follower pin is tapered by shaving the follower pin for enhancing connector releasing property, a strength of the follower pin is lowered. Accordingly, at the time of making the male connector and the female connector engage with each other by fitting, there is a concern that the follower pin is removed from the cam groove so that fitting engagement between the male connector and the female connector becomes poor.

The disclosure has been made to overcome the above-mentioned drawbacks, and it is an object of the disclosure to provide a lever-type connector which can enhance maintaining property of a temporary setting state between a male connector and a female connector, and can prevent the occurrence of a state where, at the time of making the male connector and the female connector engage with each other by fitting, a cam boss is removed from a cam groove so that fitting engagement between the male connector and the female connector becomes poor.

According to an embodiment, there is provided a lever-type connector including: a first connector; a second connector; and a lever which is mounted on the first connector, and is configured to pull the first connector and the second connector to each other from a connector temporary set state so as to engage the first connector and the second connector with each other by fitting, due to a rotational manipulation of the lever from a lever rotation start position to a lever rotation completion position, wherein the first connector has a support shaft which forms a rotary shaft of the lever, the second connector has a cam groove for pulling in the first connector, and a temporary locking projection disposed at an inlet of the cam groove, the lever has a bearing portion which is rotatably supported on the support shaft, and a cam boss which engages with the cam groove, at the connector temporary set state, the first connector is configured to be prevented from moving in a connector removal direction where the first connector is removed from the second connector, by engaging the cam boss of the lever, which is positioned at the lever rotation start position, with the cam groove in a state where the cam boss is locked to the temporary locking projection, a projection is formed on an outer side of the cam boss in the connector removal direction; and the projection has a tapered portion which obliquely faces a surface of the temporary locking projection on a connector removal direction side.

According to the embodiment, the cam boss of the lever is guided into the cam groove of the second connector and is locked to the temporary locking projection so that the first connector and the second connector are brought into the connector temporary setting state. In releasing the connector temporary setting state, the tapered portion of the projection of the cam boss disposed on the connector removal direction side and the temporary locking projection of the cam groove slide each other. Accordingly, the cam boss is not shaved by the cam groove and hence, it is possible to prevent lowering of a strength of the cam boss.

DETAILED DESCRIPTION

Hereinafter, an embodiment of the disclosure will be described with reference to drawings.

One embodiment of the disclosure will be described with reference to FIGS. 1 to 21.

Figure 1:
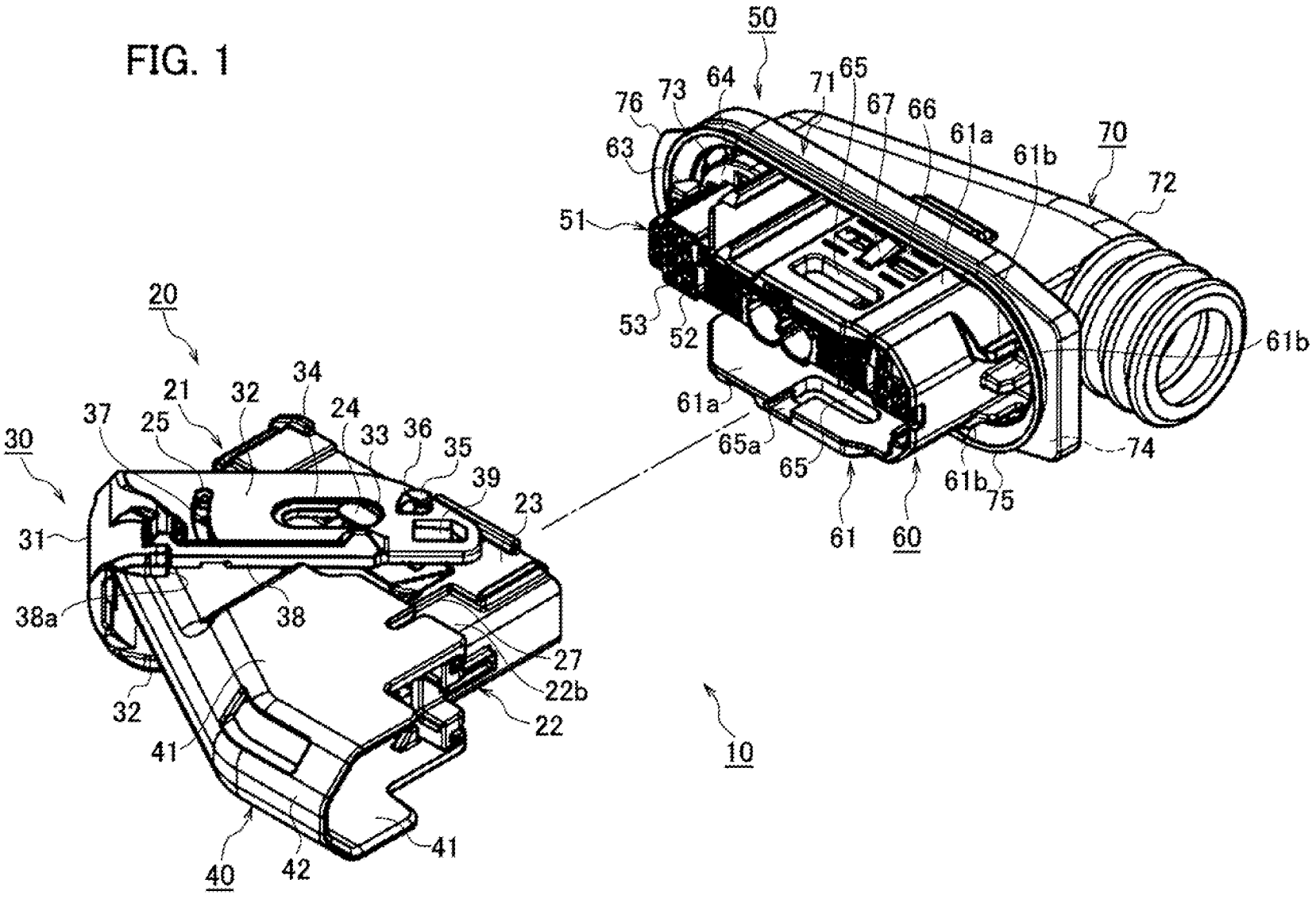
FIG. 1 is a perspective view illustrating a state of a lever-type connector according to one embodiment of the disclosure before fitting engagement.
Figure 20:
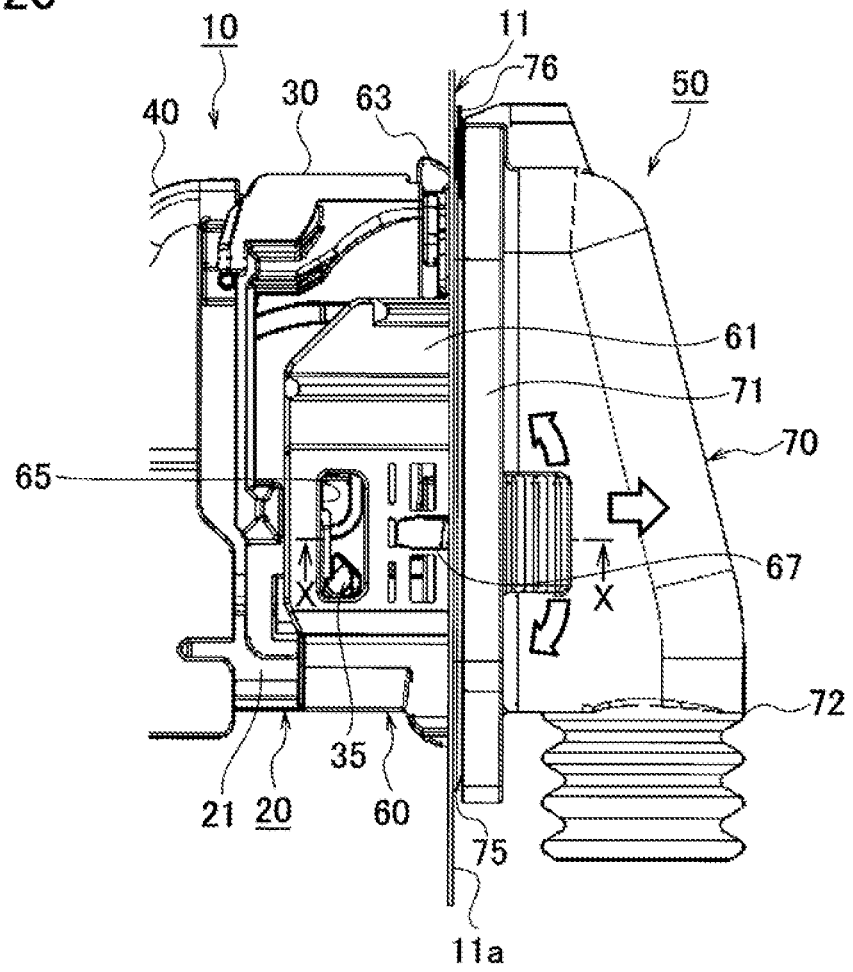
FIG. 20 is a side view of the lever-type connector illustrating a state where the lever-type connector is assembled to the vehicle body panel.

As illustrated in FIGS. 1 and 20, a lever-type connector 10 includes a male connector (first connector) 20 and a female connector (second connector) 50. The male connector 20 is disposed on an inner side of a vehicle body panel (panel) 11 (a side opposite to a door side). The female connector 50 is disposed on an outer side of the vehicle body panel 11 (door side).

Figure 4:
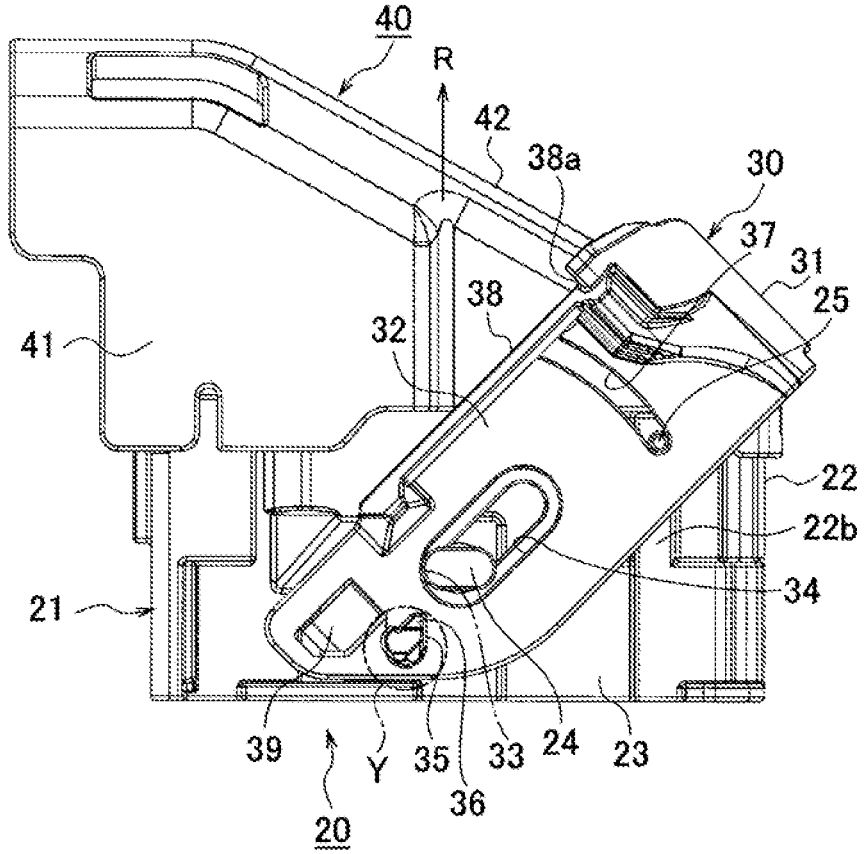
FIG. 4 is a side view of the male connector at the time of temporary setting releasing.
Figure 6:
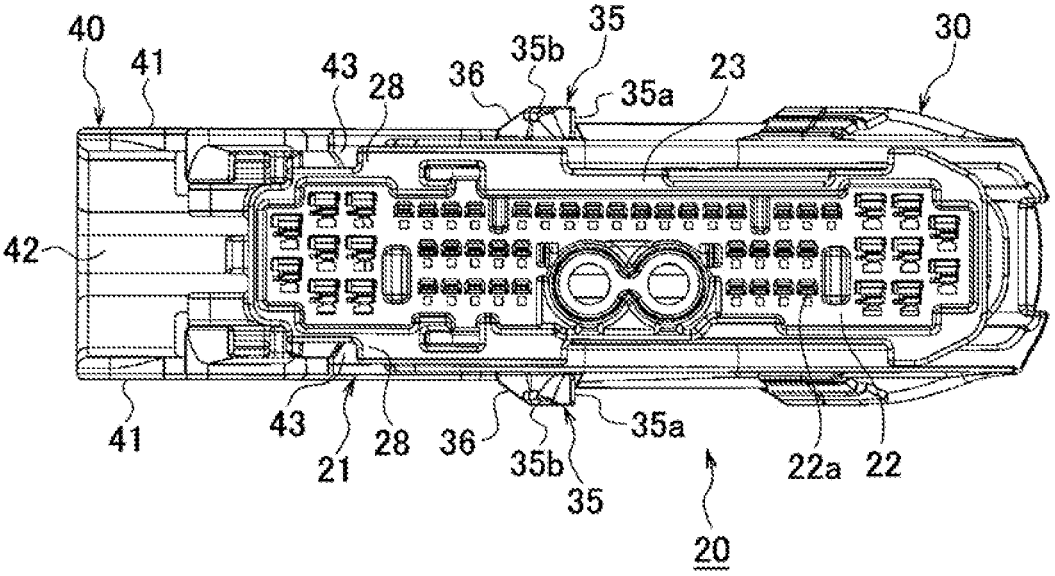
FIG. 6 is a bottom view of the male connector at the time of temporary setting releasing.
Figure 7:
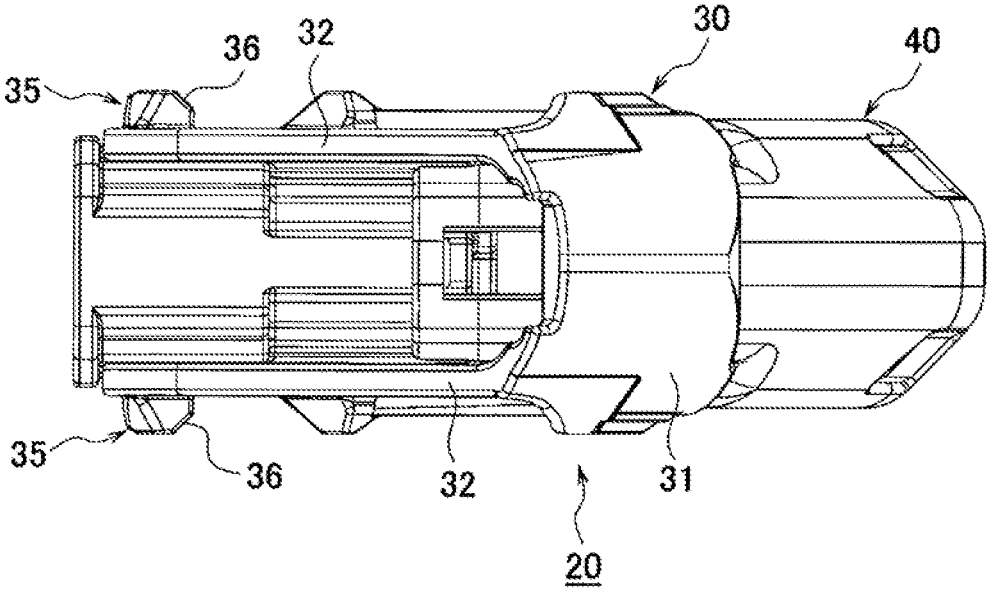
FIG. 7 is a plan view of the male connector at the time of temporary setting releasing.

As illustrated in FIGS. 1, 4, and 6, the male connector 20 includes a male housing 21 made of a synthetic resin, a lever 30 made of a synthetic resin, and a cable cover 40 made of a synthetic resin. The male housing 21 houses a plurality of male terminals (terminals) not illustrated in the drawing, and engages with a female housing 51 of the female connector 50 by fitting in a detachable manner. The lever 30 is rotatably supported on the male housing 21 by way of support shafts 24, 24 (only the support shaft 24 on one side is illustrated in FIGS. 1 and 4). The lever 30 is also slidably supported on the male housing 21. Due to the rotational manipulation of the lever 30, the male housing 21 and the female housing 51 engage with each other by fitting or are disengaged from each other. The cable cover 40 is mounted on the male housing 21 so as to cover a rear side of the male housing 21 (a side opposite to a side where the male connector 20 opposedly faces the female connector 50).

Figure 2:
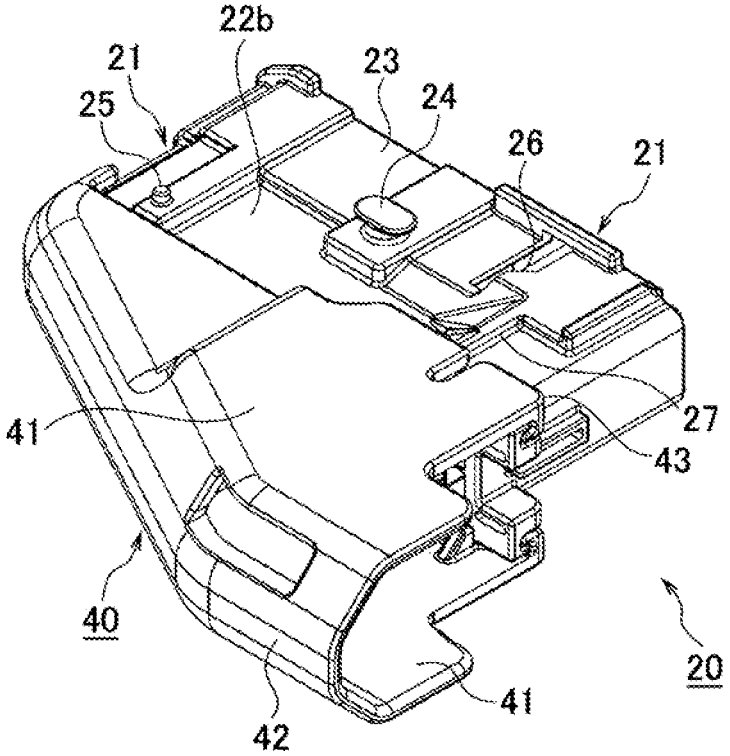
FIG. 2 is a perspective view of a male connector of the lever-type connector.

As illustrated in FIGS. 1, 2, and 6, the male housing 21 has a housing body 22 having a rectangular block shape and a hood portion 23. The housing body 22 has a plurality of terminal housing holes 22*a* in which male terminals are housed. The hood portion 23 is integrally formed on a front side of the housing body 22 (a side where the male connector 20 opposedly faces the female connector 50) in a protruding manner. A housing body 52 of the female housing 51 is fitted in the hood portion 23. The support shafts 24, 24 which extend in a direction perpendicular to a fitting direction of the connector are respectively integrally formed on boundaries between the centers of both side surfaces 22*b*, 22*b* of the housing body 22 and the hood portion 23 in a protruding manner. The support shafts 24, 24 are rotary shafts of the lever 30.

Guide projections 25, 25 are respectively integrally formed on a rear side of both side surfaces 22*b*, 22*b* of the housing body 22 (a side opposite to a side where the male connector 20 opposedly faces the female connector 50), and at a position close to a manipulating portion 31 of the lever 30 described later, in a protruding manner. As illustrated in FIG. 2, temporary locking recessed portions (portions to be temporarily locked) 26, 26 and main locking recessed portions (portions to be mainly locked) 27, 27 are respectively formed on the hood portion 23 and both side surfaces 22*b*, 22*b* of the housing body 22, at positions corresponding to rotational trajectories of projection portions 39*a*, 39*a* of locking arms (locking portions) 39, 39 of the lever 30 described later.

Figure 3:
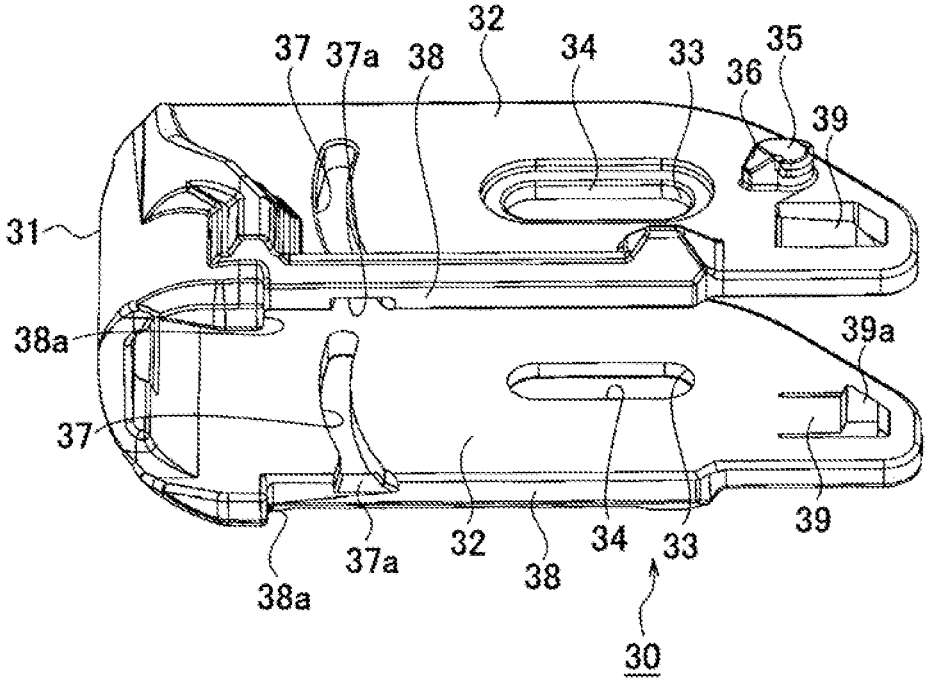
FIG. 3 is a perspective view of a lever of the lever-type connector.

As illustrated in FIGS. 1, 3, and 4, the lever 30 is mounted on the male housing 21 such that the lever 30 covers a part of the male housing 21 of the male connector 20 and a part of the cable cover 40. Due to a rotational manipulation of the lever 30 from a lever rotation start position illustrated in FIG. 12A to a lever rotation completion position illustrated in FIG. 13A, the male connector 20 and the female connector 50 are pulled close to each other and hence, the male connector 20 and the female connector 50 engage with each other by fitting. The lever 30 includes the manipulating portion 31, and a pair of arm portions 32, 32 which extends from both sides of the manipulating portion 31.

As illustrated in FIGS. 1, 3, and 4, a bearing hole (bearing portion) 33 is formed at the center of each arm portion 32 of the lever 30. The bearing hole 33 has a shaft slide groove 34 in which the support shaft 24 slides. A cam boss 35 having a columnar shape is integrally formed on each arm portion 32 in a protruding manner.

Figure 5:
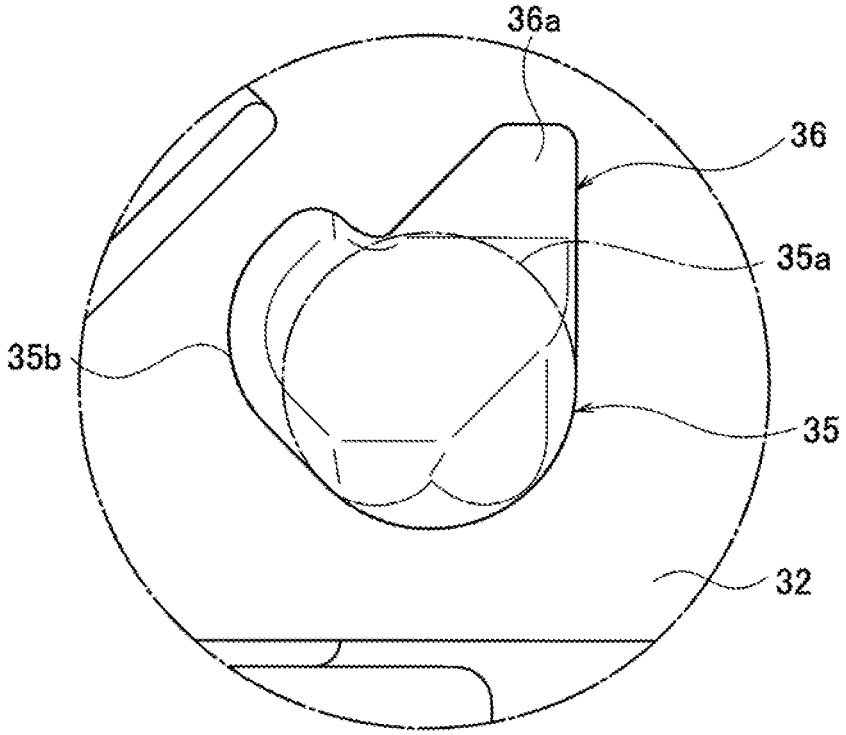
FIG. 5 is an enlarged view of a Y-portion in FIG. 4.
Figure 13A:
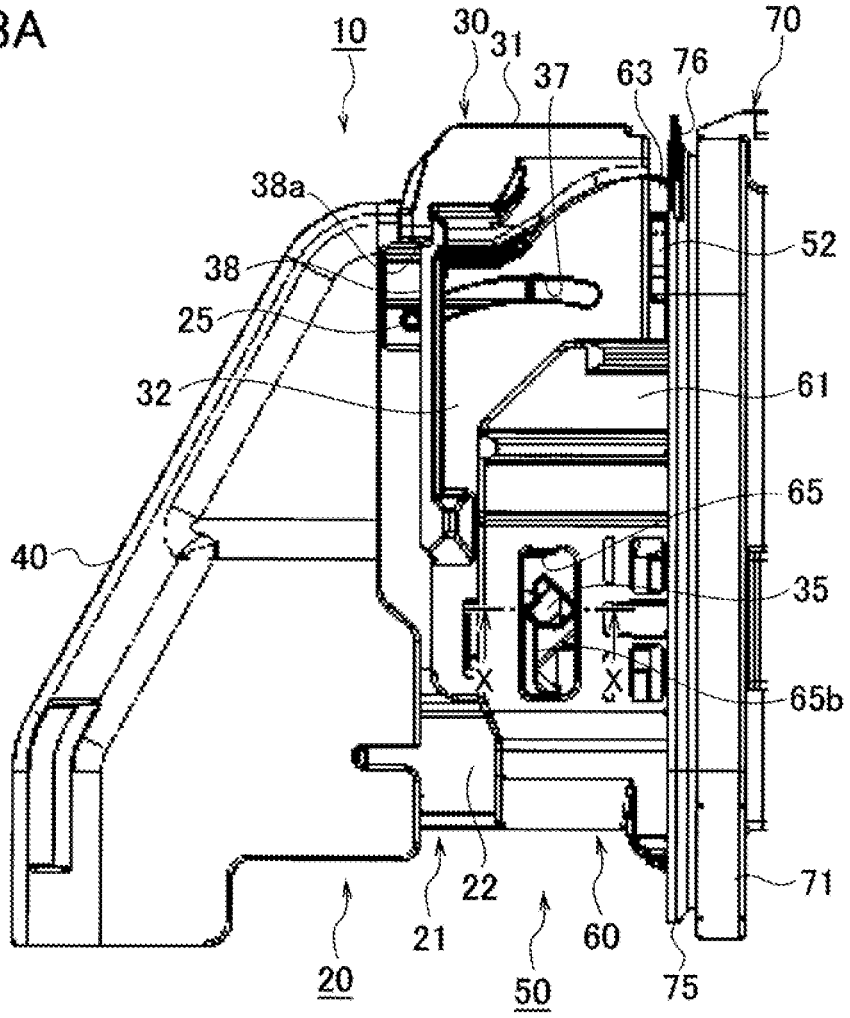
FIG. 13A is a side view illustrating a state where the rotation of the lever of the lever-type connector is completed.
Figure 13B:
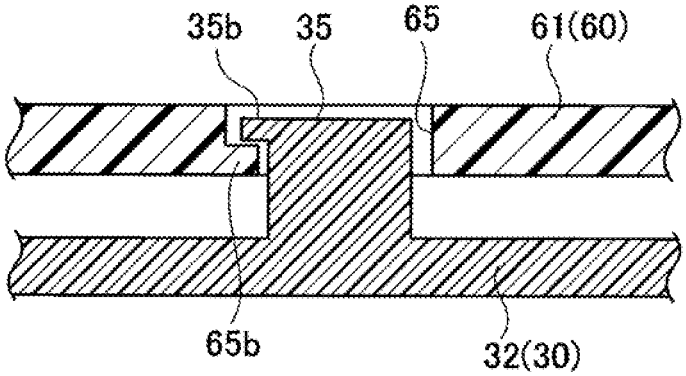
FIG. 13B is a schematic cross-sectional view taken along line X-X in FIG. 13A.

As illustrated in FIGS. 4 to 7, a projection 36 having a tapered portion 36*a* is integrally formed on an outer side of the cam boss 35 in a temporary setting releasing direction (connector removing direction) R, in a protruding manner. In making the male connector 20 and the female connector 50 engage with each other by fitting, the tapered portion 36*a* obliquely faces a surface of a temporary locking projection 65*a* of a cam groove 65 described later on a temporary setting releasing direction R side. Further, as illustrated in FIGS. 5 and 13B, a position restricting rib 35*b* which engages with a pull-in rib 65*b* of the cam groove 65, is integrally formed on an upper end of a shaft portion 35*a* of the cam boss 35 in a protruding manner.

As illustrated in FIG. 3, an arcuate guide groove 37 with which the guide projection 25 engages, is formed in each arm portion 32 between the manipulating portion 31 and the bearing hole 33. The guide groove 37 is formed in an elongated arcuate shape having its center at the bearing hole 33. A catching taper 37*a* which guides the guide projection 25, is formed on an open end side of the guide groove 37.

Figure 14:
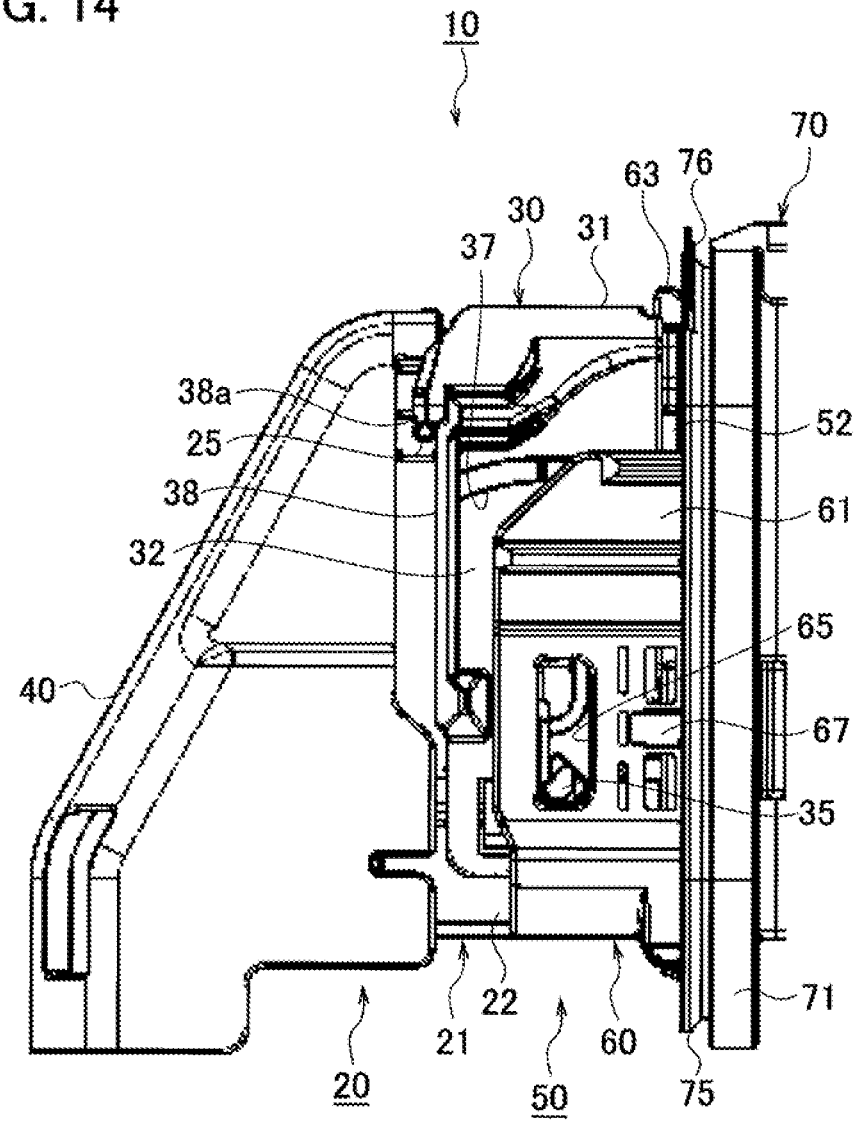
FIG. 14 is a side view of the lever-type connector in a state where sliding of the lever of the lever-type connector is completed.

As illustrated in FIG. 3, a slide portion 38 along which the guide projection 25 slides in a slide direction after rotation of the lever 30, is formed on each arm portion 32 of the lever 30. The slide portion 38 is formed in a rail shape such that an inner side of the slide portion 38 is indented. Further, a contact portion 38*a* is formed on each arm portion 32. The guide projection 25 is brought into contact with the contact portion 38*a* at end of sliding of the guide projection 25 after rotation of the lever 30. Due to the rotational manipulation of the lever 30, the guide projection 25 slides in the guide groove 37, and after the fitting engagement between the male connector 20 and the female connector 50 is completed, the guide projection 25 slides along the slide portion 38 until the guide projection 25 is brought into contact with the contact portion 38*a*. With such a configuration, as illustrated in FIGS. 13A and 14, the lever 30 can slide relative to the housing body 22 of the male housing 21.

As illustrated in FIGS. 1 and 3, the locking arm (locking portion) 39 which elastically deforms in a direction perpendicular to a fitting direction of the housing, is formed on an outer side of a distal end of each arm portion 32 of the lever 30. A projection portion 39*a* of the locking arm 39 is locked to or removed from the temporary locking recessed portion 26 or the main locking recessed portion 27. With such a configuration, the locking arm 39 makes the lever 30 locked to or removed from the temporary locking recessed portion 26 or the main locking recessed portion 27.

As illustrated in FIGS. 1 and 2, the cable cover 40 has a pair of side wall portions 41, 41 which forms an opening, and a ceiling wall portion 42 having a curved surface shape and a bent shape. As illustrated in FIG. 6, when the cable cover 40 is slid and mounted on a rear end side of the housing body 22 of the male housing 21 (an end portion of the housing body 22 on a side opposite to a side where the male connector 20 opposedly faces the female connector 50), locking portions 43, 43 formed on lower ends of the side wall portions 41, 41 are locked to portions-to-be-locked 28, 28 formed on the housing body 22.

As illustrated in FIG. 1, the female connector 50 equipped with a grommet includes the female housing 51 and a grommet 70 made of rubber. The female housing 51 has a plurality of terminal housing chambers 53 in which female terminals (terminals) not illustrated in the drawings are housed. The female housing 51 includes the housing body 52 made of a synthetic resin and a cylindrical frame 60 made of a synthetic resin. The housing body 52 is configured to engage with the male housing 21 of the male connector 20 by fitting and to be removed from the male housing 21. The frame 60 is fitted on an outer circumference of the housing body 52 exteriorly, and is locked to the mounting hole 12 formed in the vehicle body panel 11. The grommet 70 is mounted on a flange 62 of the frame 60.

As illustrated in FIG. 1, the housing body 52 has the plurality of terminal housing chambers 53 in which the female terminals are housed, and the housing body 52 is formed in a rectangular block shape. Release projections (release portions) not illustrated in the drawings, are formed on both side surfaces of the housing body 52 at positions where the releasing projections opposedly face the temporary locking recessed portions 26, 26 formed on both side surfaces 22*b*, 22*b* of the male housing 21. The releasing projections release a temporary locked state between the projection portions 39*a*, 39*a* of the locking arms 39, 39 of the lever 30 and the temporary locking recessed portions 26, 26.

Figure 8:
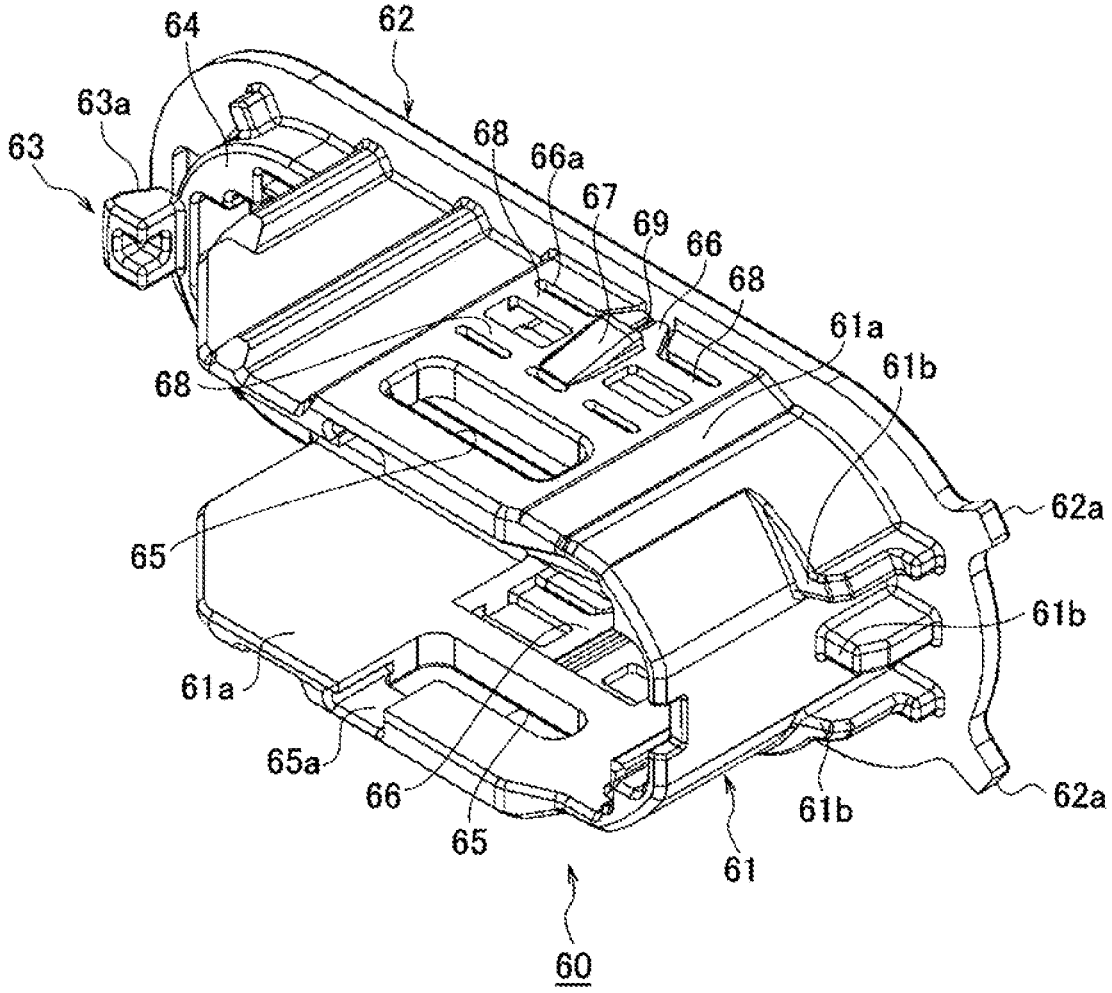
FIG. 8 is a perspective view of a frame of a female connector of the lever-type connector.

As illustrated in FIG. 8, the frame 60 has a cylindrical frame body 61 where an upper surface side is cut away, and the flange 62 having an annular plate shape. The flange 62 is integrally formed on one end side of the frame body 61 over the entire circumference of the frame body 61 in a protruding manner toward the outside. In mounting the female connector 50 on the vehicle body panel 11, the flange 62 opposedly faces an edge portion 12*a* of the mounting hole 12 of the vehicle body panel 11.

A panel hooking portion 63 is formed on an upper side of the frame body 61. The panel hooking portion 63 is locked to the edge portion 12*a* of the mounting hole 12 by hooking. By rotating the female housing 51 using the panel hooking portion 63 as a fulcrum in a state where the panel hooking portion 63 is hooked on the edge portion 12*a* of the mounting hole 12, it is possible to make locking projections 67, 67 described later locked to the mounting hole 12. A catching taper 63*a* is formed on a flange 62 side of the panel hooking portion 63.

As illustrated in FIGS. 1 and 8, a locking frame portion 64 is formed on a lower side of the panel hooking portion 63 of the frame body 61. The locking frame portion 64 locks the housing body 52 of the female housing 51 arranged in both side wall portions 61*a*, 61*a* of the frame body 61 with a gap. A plurality of butting portions 61*b* is formed on a lower side of the frame body 61. The butting portions 61*b* are brought into contact with the vehicle body panel 11 when the locking projections 67, 67 described later are not correctly locked to the mounting hole 12 of the vehicle body panel 11. The hood portion 23 of the housing body 22 of the male housing 21 is fitted in between the housing body 52 of the female housing 51 and the cylindrical frame body 61 of the frame 60. A pair of projection portions 62*a*, 62*a* is integrally formed on an outer side of the flange 62 of the frame 60 in a protruding manner at positions where the projection portions 62*a*, 62*a* opposedly face the butting portions 61*b*, 61*b* positioned on both end sides among the plurality of butting portions 61*b*. The projection portions 62*a*, 62*a* are inserted into a deep groove portion 74 formed on a deep side of a flange fitting groove 73 of the grommet 70 described later in a non-penetrating manner.

Figure 9:
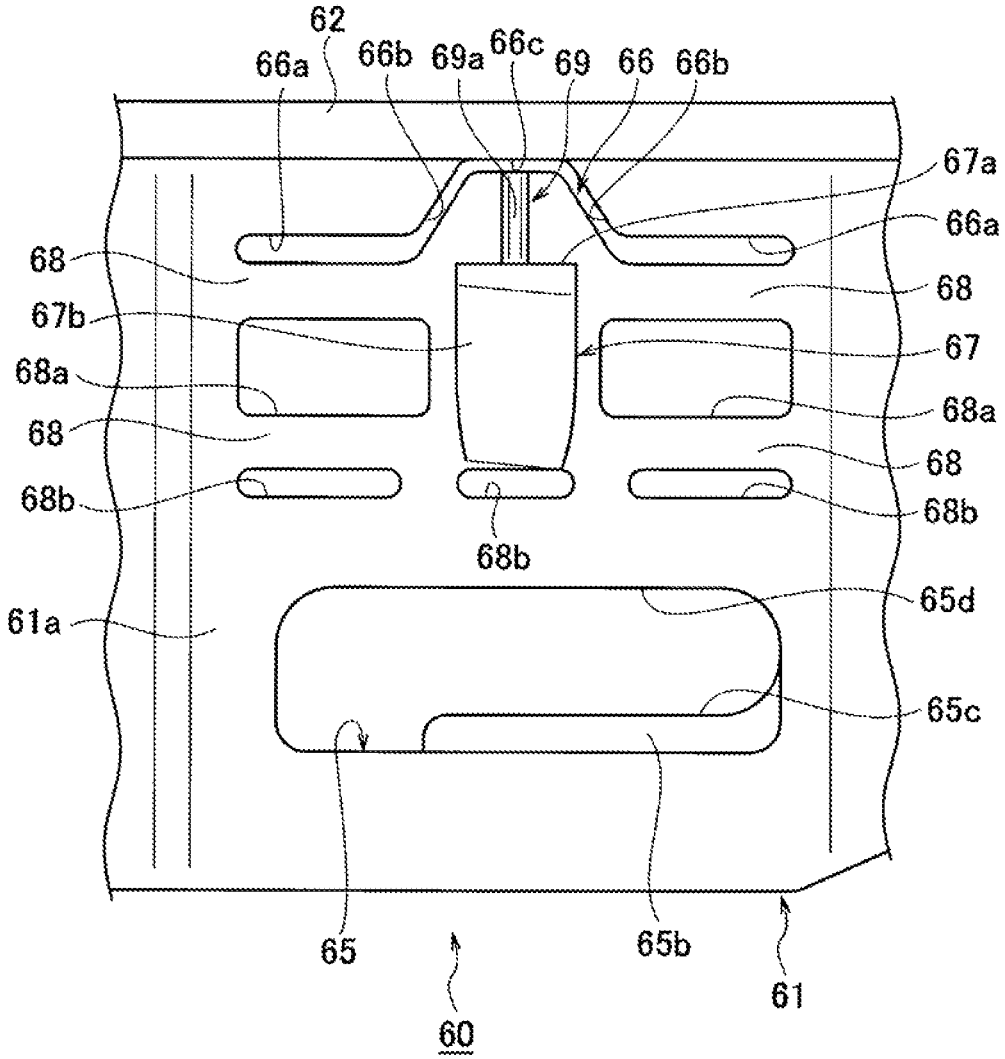
FIG. 9 is an enlarged side view of a main part of the frame.

As illustrated in FIGS. 8 and 9, cam grooves 65, 65 with which the cam bosses 35, 35 of the lever 30 engage, are formed on the centers of both side wall portions 61*a*, 61*a* of the frame body 61 on a side opposite to the flange 62. Each cam groove 65 has the temporary locking projection 65*a*, the pull-in rib 65*b* and a pushing-side slide surface 65*d*. The temporary locking projection 65*a* is disposed on an inlet side of the cam groove 65. A pull-in side slide surface 65*c* which extends from the temporary locking projection 65*a* in an L shape, is formed on the pull-in rib 65*b*. The pushing-side slide surface 65*d* opposedly faces the pull-in side slide surface 65*c* of the pull-in rib 65*b*.

Figure 21:
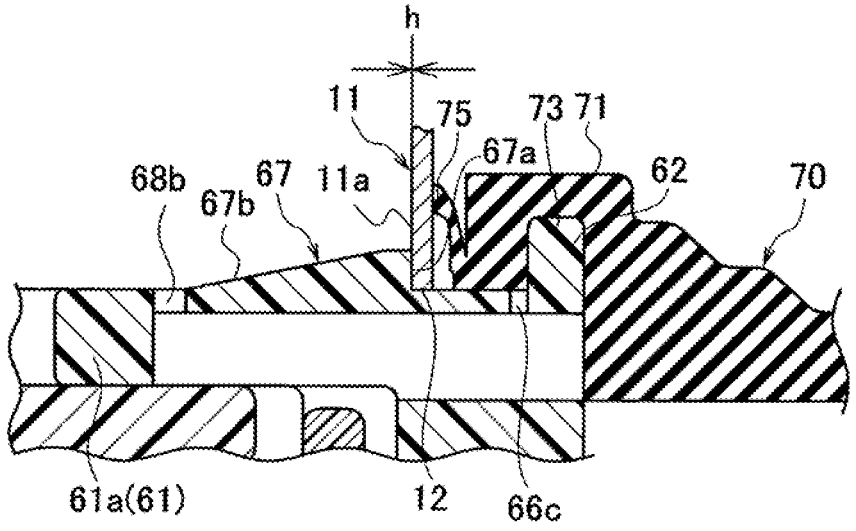
FIG. 21 is a cross-sectional view of the lever-type connector taken along line X-X in FIG. 20.

As illustrated in FIG. 9, resilient arms 66, 66 which are elastically deformable are respectively integrally formed on the centers of both side wall portions 61*a*, 61*a* of the frame body 61 at a position close to the flange 62. Each resilient arm 66 is supported on the side wall portion 61*a* in a cantilever manner by forming straight-line slits 66*a*, 66*a* which are positioned on both left and right sides of the resilient arm 66, inclined slits 66*b*, 66*b* which communicate with the straight-line slits 66*a*, 66*a*, and a center slit 66*c* which communicates with the inclined slits 66*b*, 66*b*. As illustrated in FIG. 21, each locking projection 67 is integrally formed on the center of each resilient arm 66 in a protruding manner. The locking projections 67, 67 are locked to the vehicle body panel 11 in a state where the vehicle body panel 11 is sandwiched between the locking projections 67, 67 and the flange 62 by way of a waterproof lip 75 of the grommet 70 described later. Each locking projection 67 has: a vertical locking surface 67*a* which is locked to the edge portion 12*a* of the mounting hole 12 of the vehicle body panel 11; and an inclined surface (tapered surface) 67*b* which guides the locking projection 67 into the mounting hole 12. The inclined surface 67*b* is formed such that the vehicle body panel 11 and the locking projection 67 are brought into contact with each other at a right angle even when the female housing 51 is inclined at the time of assembling the locking projection 67 into the mounting hole 12.

As illustrated in FIG. 9, a pair of auxiliary arms 68, 68 extending in a direction orthogonal to the resilient arm 66 is formed on both sides of the locking projection 67 of the resilient arm 66 by way of cutouts 68*a*, 68*a* and slits 68*b*, 68*b* having a rectangular shape respectively. A release portion 69 is formed between the locking projection 67 of the resilient arm 66 and the slit 66*c*. The release portion 69 is operated by a release jig (not illustrated in the drawings) inserted along the flange 62. A recessed groove 69*a* with which a distal end of the release jig is brought into contact, is formed on the release portion 69.

Figure 10:
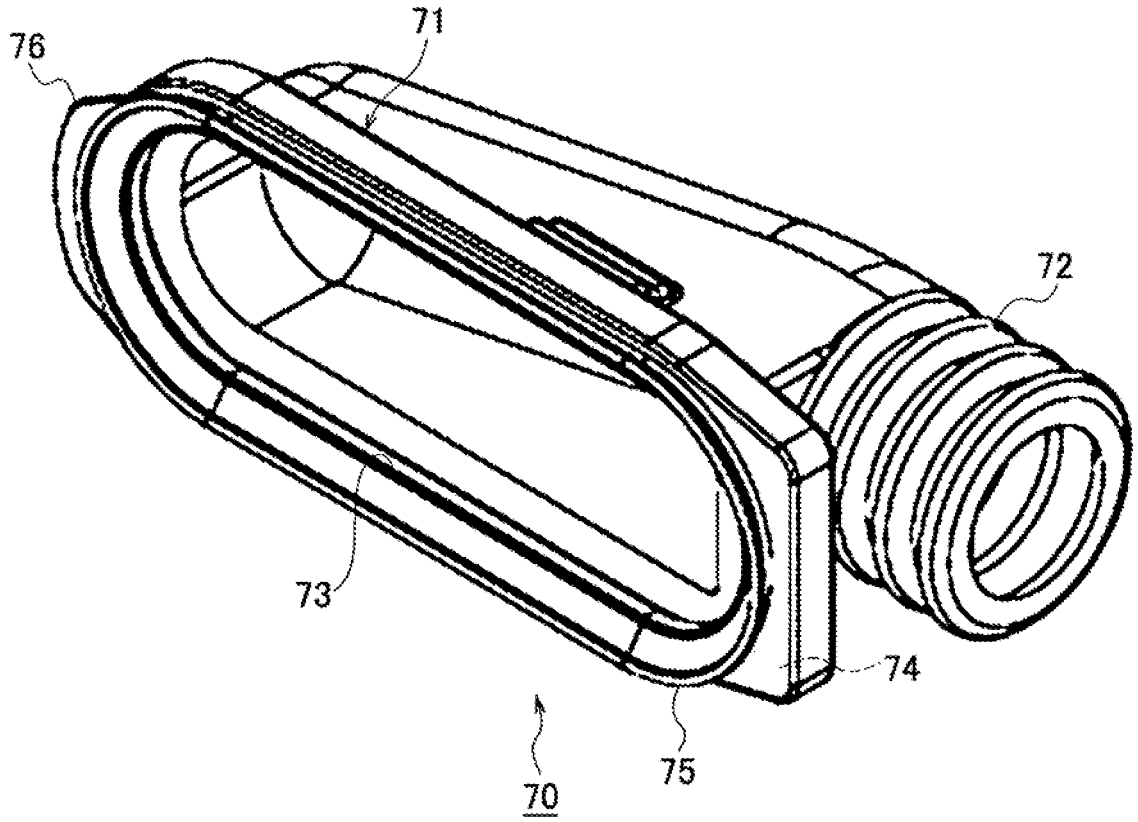
FIG. 10 is a perspective view of a grommet to be mounted on a flange of the frame.

As illustrated in FIGS. 1 and 10, the grommet 70 includes a panel close contact portion 71 and a cable accommodating portion 72. The panel close contact portion 71 is fitted on the flange 62 so as to cover the flange 62. In mounting the female connector 50 on the vehicle body panel 11, the panel close contact portion 71 is brought into close contact with the edge portion 12*a* of the mounting hole 12 of the vehicle body panel 11.

As illustrated in FIG. 10, a flange fitting groove 73 is formed on an inner side of the panel close contact portion 71. The flange 62 is inserted into the flange fitting groove 73 over the entire circumference of the flange 62. The deep groove portion 74 is formed on a lower side of the flange fitting groove 73. The projection portions 62*a*, 62*a* of the flange 62 are inserted into the deep groove portion 74 in a non-penetrating manner. The waterproof lip 75 is integrally formed on an outer side of the panel close contact portion 71. In mounting the female connector 50 on the vehicle body panel 11, the waterproof lip 75 is pressed against a wall surface 11*a* of the vehicle body panel 11 around the edge portion 12*a* of the mounting hole 12 and hence, and the waterproof lip 75 is brought into close contact with the edge portion 12*a*.

A guide rib 76 is integrally formed on the panel close contact portion 71 in a tongue shape in a protruding manner at a position where the guide rib 76 opposedly faces the panel hooking portion 63 of the frame 60. The guide rib 76 is brought into contact with the wall surface 11*a* of the vehicle body panel 11 prior to the waterproof lip 75 at the time of assembling the female housing 51 to the vehicle body panel 11. After the female housing 51 is assembled to the vehicle body panel 11, the guide rib 76 is separated from the wall surface 11*a* of the vehicle body panel 11 and is not brought into contact with the wall surface 11*a*, and the waterproof lip 75 is pressed against the wall surface 11*a* of the vehicle body panel 11 and is brought into close contact with the wall surface 11*a*.

Figure 11:
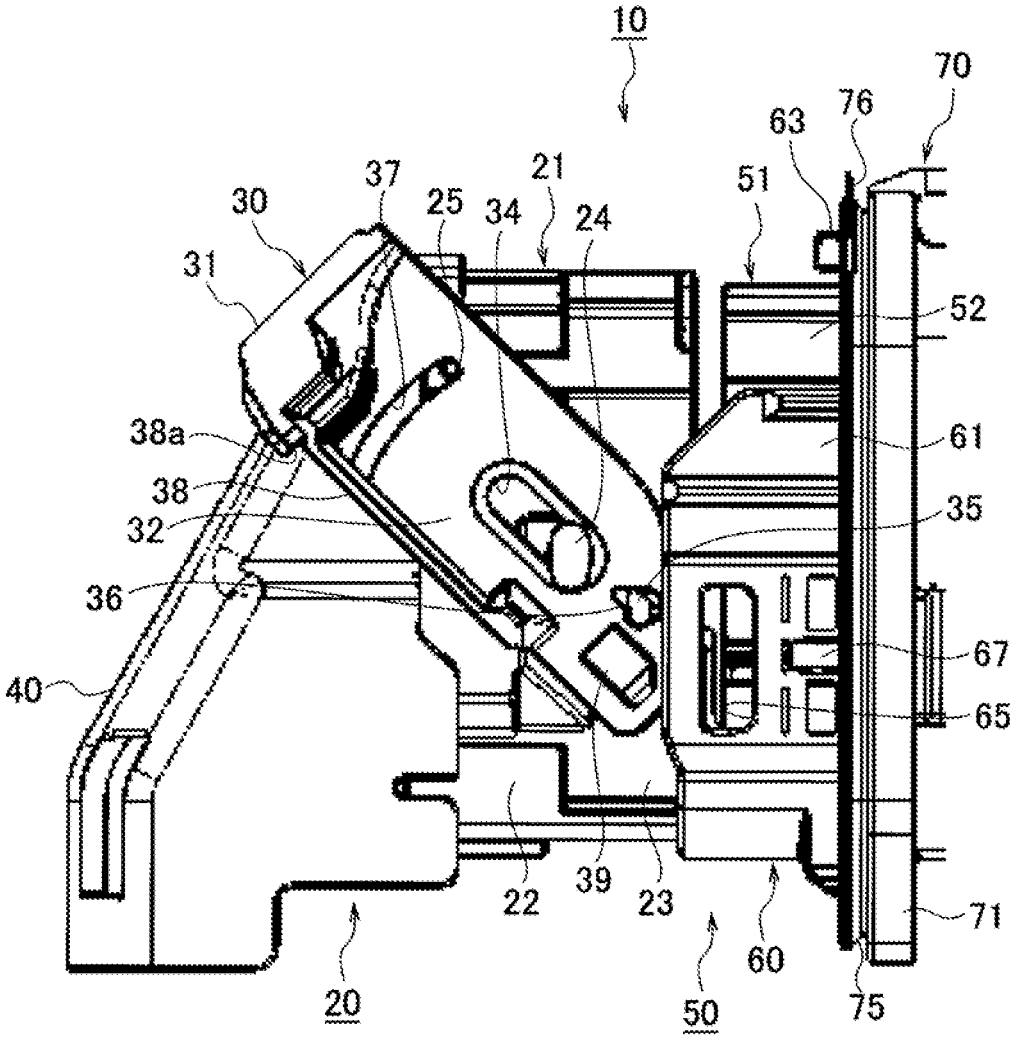
FIG. 11 is a side view illustrating a state before the lever-type connector is temporarily set.

As has been described above, according to the lever-type connector 10 of the embodiment, before the lever-type connector 10 is assembled to the mounting hole 12 of the vehicle body panel 11 (before the lever-type connector 10 is temporarily set), as illustrated in FIGS. 4 and 11 (it is noted that FIG. 11 illustrates one sides of the male connector 20 and female connector 50), the temporary locked state of the lever 30 is held by assembling the bearing holes 33, 33 formed in the lever 30 and having the shaft slide grooves 34, 34 to the support shafts 24, 24 of the male housing 21 of the male connector 20, and by temporarily locking the projection portions 39*a*, 39*a* of the locking arms 39, 39 of the lever 30 to the temporary locking recessed portions 26, 26 of the male housing 21. When the lever 30 is in the temporary locked state with respect to the male housing 21, the lever 30 cannot be rotated in the fitting direction of the male housing 21 and the female housing 51 of the female connector 50.

When the housing body 52 of the female housing 51 is pushed into the hood portion 23 of the male housing 21 in the temporary locked state of the lever 30, the release projections (not illustrated in the drawings) of the housing body 52 elastically deform the locking arms 39, 39 of the lever 30 to the outside. As a result, the temporary locked state of the temporary locking recessed portions 26, 26 of the male housing 21 and the projection portions 39*a*, 39*a* of the locking arm 39, 39 of the lever 30 is released and hence, the lever 30 can rotate in the fitting direction of the male housing 21 and the female housing 51.

Figure 12A:
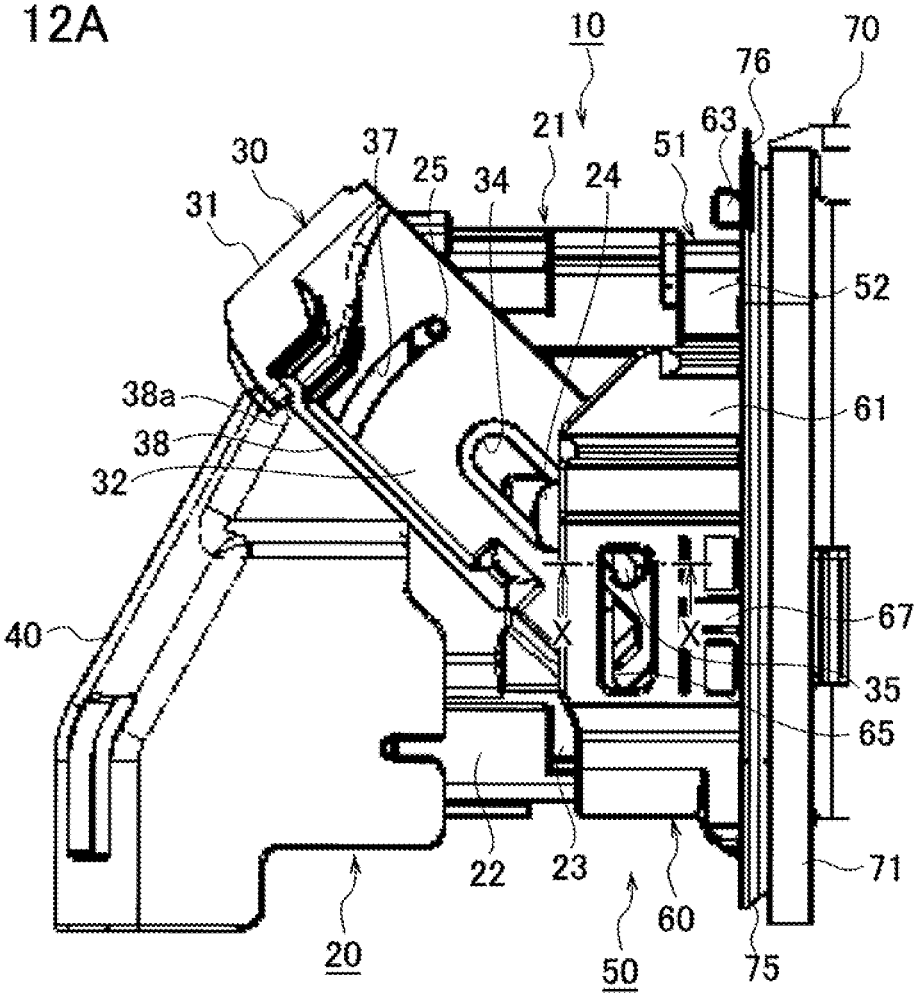
FIG. 12A is a side view of the lever-type connector in a temporary setting state at the time of starting rotation of the lever.
Figure 12B:
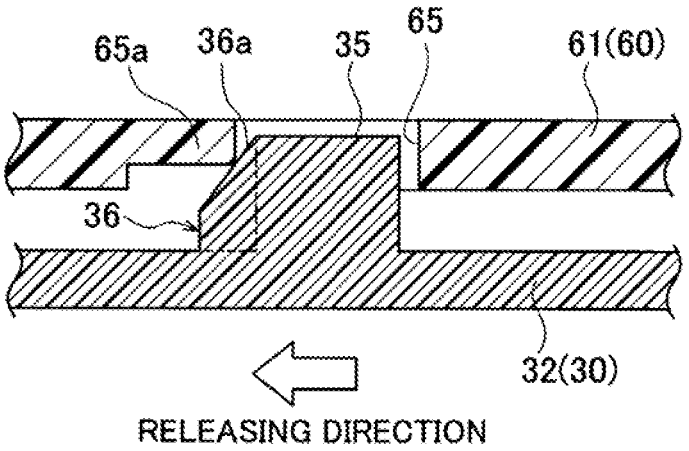
FIG. 12B is a cross-sectional view taken along line X-X in FIG. 12A.

Next, as illustrated in FIG. 12A (it is noted that FIG. 12A illustrates one sides of the male connector 20 and female connector 50), the male housing 21 and the female housing 51 are made to face each other, and the cam bosses 35, 35 of the lever 30 are inserted into the cam grooves 65, 65 of the frame 60 of the female connector 50 so that the cam bosses 35, 35 are locked to the temporary locking projections 65*a*, 65*a* formed at the inlets of the cam grooves 65, 65. When the cam bosses 35, 35 of the lever 30 are locked to the temporary locking projections 65*a*, 65*a* of the cam grooves 65, 65, the male housing 21 of the male connector 20 and the female housing 51 of the female connector 50 are brought into a temporary set state. As illustrated in FIG. 12B, in releasing a temporary setting state, the male housing 21 is pulled out from the female housing 51 (the male housing 21 being pulled out in a temporary setting releasing direction R illustrated in FIG. 4) so that the tapered portions 36*a*, 36*a* of the projections 36, 36 formed on the outer side of the cam bosses 35, 35 slide on the temporary locking projections 65*a*, 65*a* of the cam grooves 65, 65. Accordingly, the male connector 20 is smoothly detached from the female connector 50.

Next, as illustrated in FIG. 13A (it is noted that FIG. 13A illustrates one sides of the male connector 20 and female connector 50), the lever 30 is rotated using the support shafts 24, 24 of the male housing 21 as rotary shafts and hence, the shaft portions 35*a*, 35*a* of the cam bosses 35, 35 are brought into contact with the pull-in side slide surfaces 65*c*, 65*c* of the cam grooves 65, 65 whereby the female housing 51 is pulled in. In such a pull in operation of the female housing 51, the position restricting ribs 35*b*, 35*b* of the cam bosses 35, 35 are brought into contact with the pull-in ribs 65*b*, 65*b* of the cam grooves 65, 65 and hence, a contact between the shaft portions 35*a*, 35*a* of the cam bosses 35, 35 and the pull-in side slide surfaces 65*c*, 65*c* of the cam grooves 65, 65 is maintained.

In such an operation, in a state where the support shafts 24, 24 of the male housing 21 are brought into slide contact with the bearing holes 33, 33 of the lever 30, the guide projections 25, 25 of the male housing 21 move along the arcuate guide grooves 37, 37 formed in the lever 30 and hence, the lever 30 is rotated.

Next, as illustrated in FIG. 13A, when the rotation of the lever 30 is completed, the lever 30 is slidable relative to the male housing 21. That is, when the rotation of the lever 30 is finished, the guide projections 25, 25 of the male housing 21 are removed from the catching tapers 37*a*, 37*a* formed on open ends of the arcuate guide grooves 37, 37 of the lever 30 and hence, the lever 30 is slidable relative to the male housing 21.

Then, as illustrated in FIG. 14 (it is noted that FIG. 14 illustrates one sides of the male connector 20 and female connector 50), by pushing the manipulating portion 31 of the lever 30, the lever 30 is slid along the guide projections 25, 25 of the male housing 21 and hence, the projection portions 39*a*, 39*a* of the locking arms 39, 39 of the lever 30 are locked to the main locking recessed portions 27, 27 of the male housing 21. In this case, the lever 30 assumes a main locked state with respect to the male housing 21. In sliding the lever 30, the support shafts 24, 24 of the male housing 21 are brought into slide contact with the shaft slide grooves 34, 34 of the lever 30. Due to sliding of the lever 30, the lever 30 is inserted into the frame 60 of the female housing 51 and hence, the fitting engagement between the male housing 21 and the female housing 51 is completed.

Next, a procedure for assembling the lever-type connector 10 where the male connector 20 and the female connector 50 engage with each other by fitting to the mounting hole 12 of the vehicle body panel 11, will be described with reference to FIGS. 15 to 20.

Figure 15:
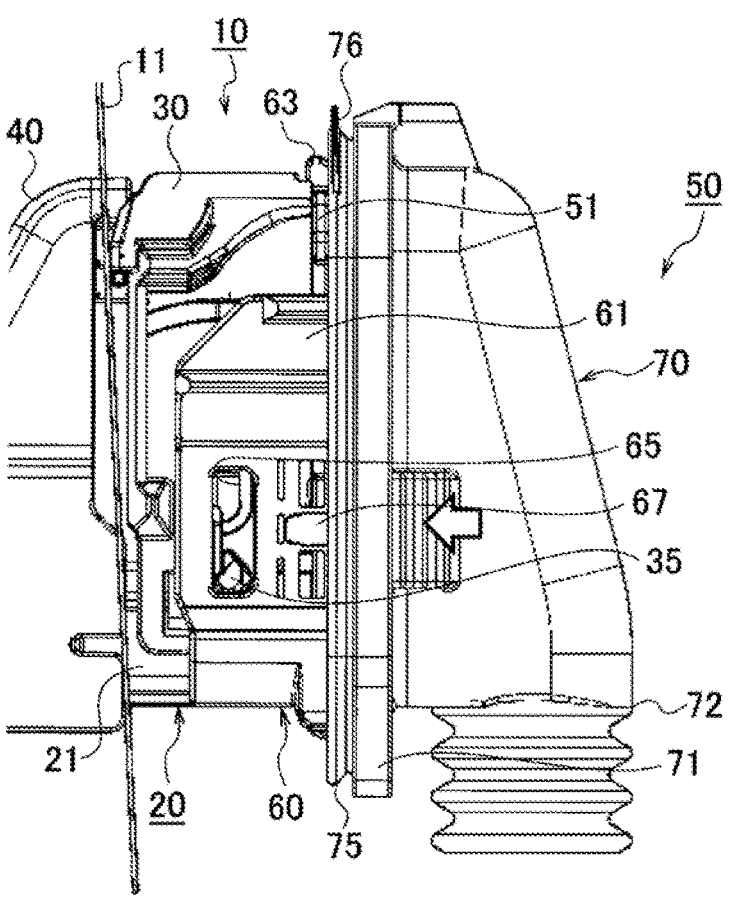
FIG. 15 is a side view of the lever-type connector in a state where the lever-type connector passes through a mounting hole formed in a vehicle body panel.
Figure 16:
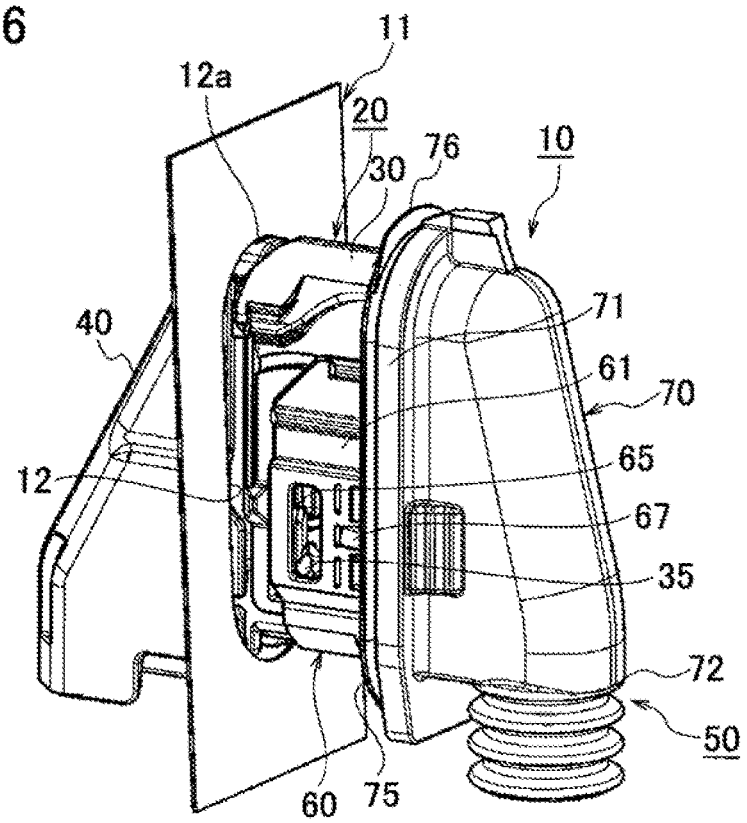
FIG. 16 is a perspective view of the lever-type connector in a state where the lever-type connector passes through the mounting hole formed in the vehicle body panel.

As illustrated in FIGS. 15 and 16, the male connector 20 which engages with the female connector 50 by fitting, is made to penetrate the mounting hole 12 of the vehicle body panel 11 from a door panel side.

Figure 17:
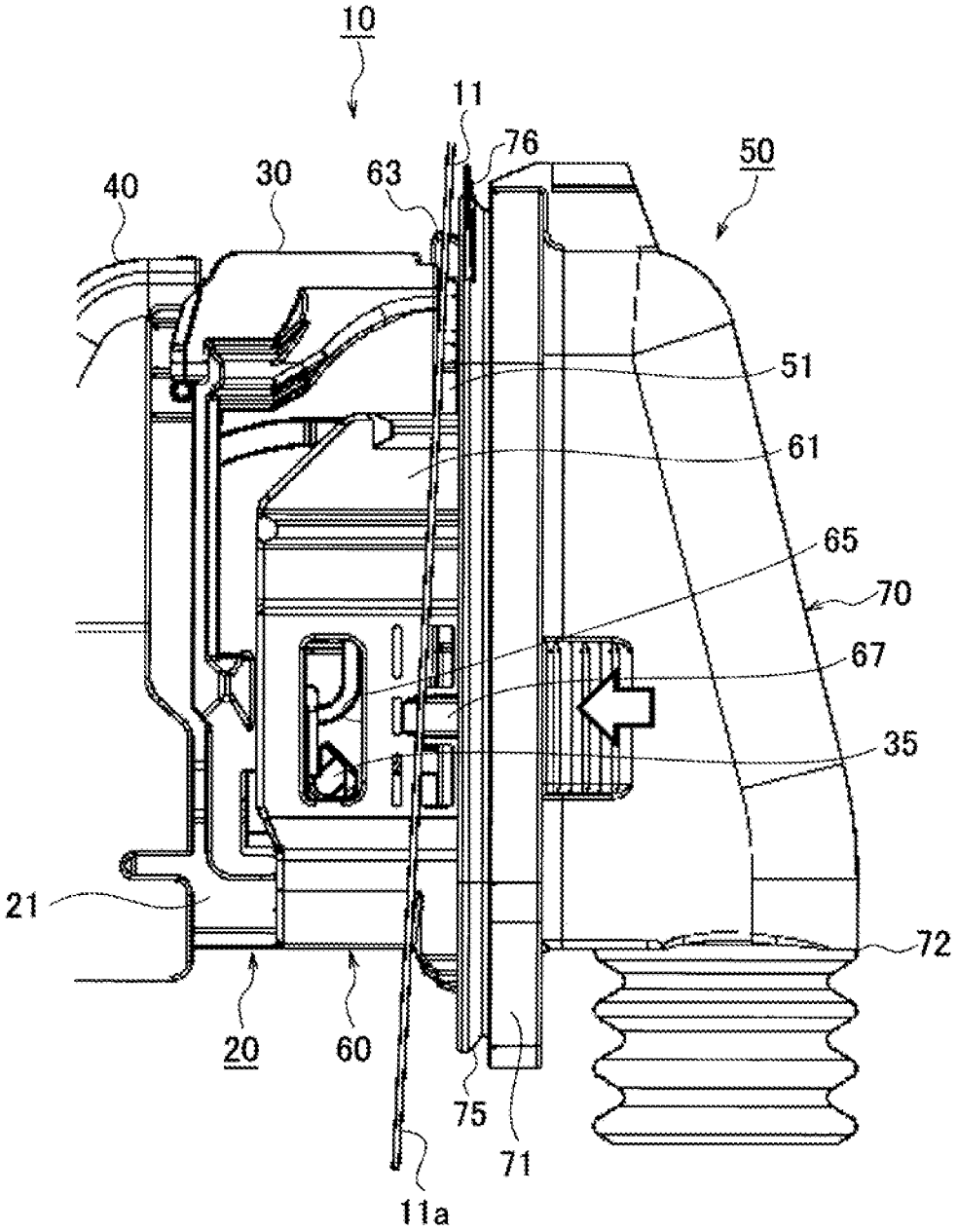
FIG. 17 is a side view of the lever-type connector illustrating a state where a panel hooking portion of the lever-type connector is inserted into the mounting hole formed in the vehicle body panel.

Next, as illustrated in FIG. 17, insertion of the panel hooking portion 63 of the frame 60 of the female connector 50 into the mounting hole 12 of the vehicle body panel 11 is started.

Figure 18:
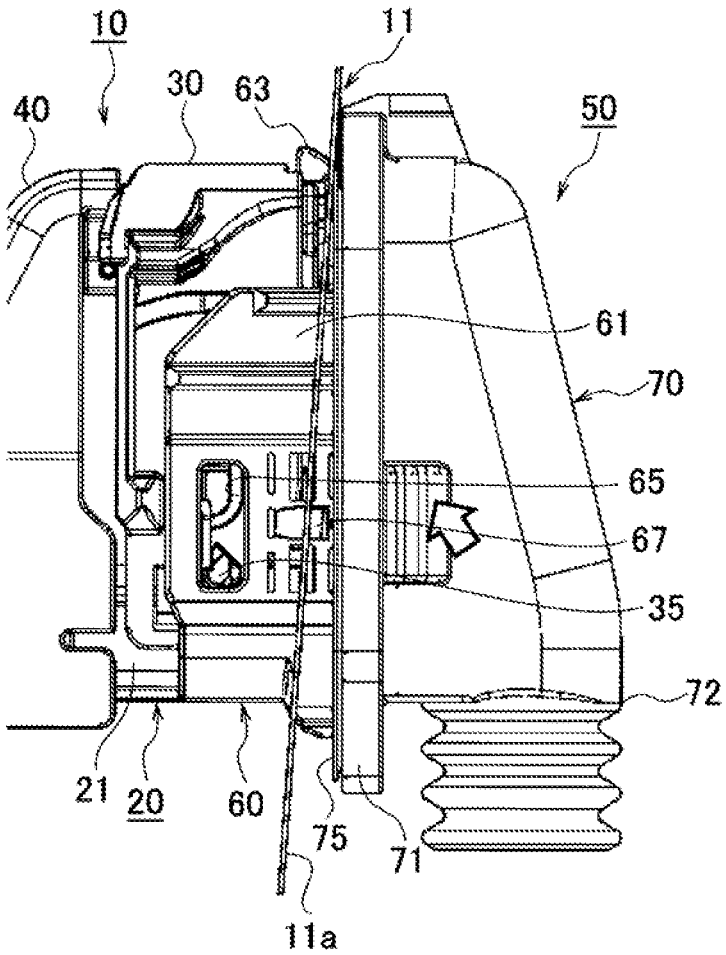
FIG. 18 is a side view of the lever-type connector in a state where the panel hooking portion of the lever-type connector is hooked on an edge portion of the mounting hole formed in the vehicle body panel.
Figure 19:
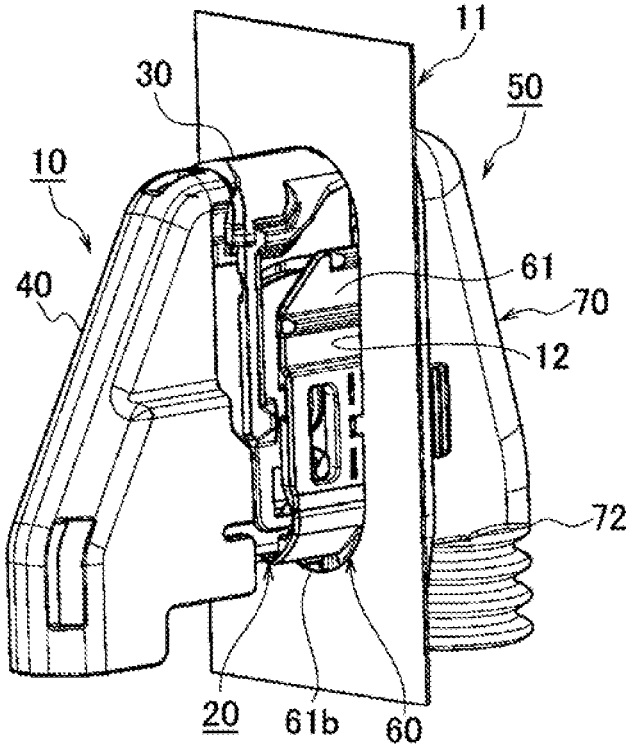
FIG. 19 is a perspective view of the lever-type connector illustrating a state where the panel hooking portion is not hooked on the edge portion of the mounting hole formed in the vehicle body panel.

As illustrated in FIG. 18, by further inserting the panel hooking portion 63 of the frame 60 into the mounting hole 12 of the vehicle body panel 11, the panel hooking portion 63 is locked to the edge portion 12*a* in a state where the panel hooking portion 63 is hooked on the edge portion 12*a* of the mounting hole 12. As illustrated in FIG. 19, in a state where the panel hooking portion 63 is not hooked on the edge portion 12*a* of the mounting hole 12, the butting portions 61*b* of the frame 60 are brought into contact with the wall surface 11*a* of the vehicle body panel 11 and hence, the locking projections 67, 67 of the frame 60 are not locked to the edge portion 12*a* of the mounting hole 12 of the vehicle body panel 11.

As illustrated in FIGS. 18 and 20, by rotating the female housing 51 using the panel hooking portion 63 of the frame 60 as a fulcrum in a state where the panel hooking portion 63 of the frame 60 is hooked on the edge portion 12*a* of the mounting hole 12 of the vehicle body panel 11, the inclined surfaces 67*b*, 67*b* of the locking projections 67, 67 of the frame 60 are brought into contact with the edge portion 12*a* of the mounting hole 12. Further, the resilient arms 66, 66 in which the locking projections 67, 67 are formed are resiliently bent and hence, the locking projections 67, 67 of the frame 60 are locked to the mounting hole 12 of the vehicle body panel 11. In such an operation, as illustrated in FIG. 21, each locking projection 67 moves in a direction perpendicular to the vehicle body panel 11 and hence, after the locking projection 67 is locked, a clearance h between the locking surface 67*a* of the locking projection 67 and the wall surface 11*a* of the vehicle body panel 11 is small. Accordingly, the waterproof lip 75 of the grommet 70 can be pushed to the wall surface 11*a* of the vehicle body panel 11 without forming a gap and hence, intrusion of water from the mounting hole 12 of the vehicle body panel 11 can be prevented.

As illustrated in FIGS. 4 and 5, each cam boss 35 of the lever 30 is guided into the temporary locking projection 65*a* disposed at an inlet of the cam groove 65 formed in the frame 60 of the female connector 50, and is locked to the temporary locking projection 65*a*. Accordingly, the male connector 20 and the female connector 50 are brought into a temporary setting state. In releasing the temporary setting state, the temporary locking projection 65*a* disposed at the inlet of the cam groove 65 slides on a tapered portion 36*a* of the projection 36 which is integrally formed on an outer side (temporary setting releasing direction R) of the shaft portion 35*a* of the cam boss 35 in a protruding manner. Accordingly, it is unnecessary to form a tapered portion on the cam boss 35 by shaving the cam boss 35 and hence, it is possible to prevent lowering of a strength of the cam boss 35. Further, the cam boss 35 is not shaved by the temporary locking projection 65*a* of the cam groove 65 and hence, it is possible to prevent lowering of a strength of the cam boss 35. That is, the projection 36 is integrally formed on the outer side (temporary setting releasing direction R) of the shaft portion 35*a* of the cam boss 35 in a protruding manner, and the tapered portion 36*a* is formed on the projection 36. Accordingly, a strength of the cam boss 35 can be enhanced by an amount corresponding to the formation of the projection 36. Accordingly, maintaining property of a temporary setting state between the male connector 20 and the female connector 50 can be enhanced, and it is possible to prevent with certainty the occurrence of a state where, at the time of making the male connector 20 and the female connector 50 engage with each other by fitting, the cam boss 35 is removed from the cam groove 65 so that fitting engagement between the male connector 20 and the female connector 50 becomes poor.

Next, a comparison example will be described.

Figure 22A:
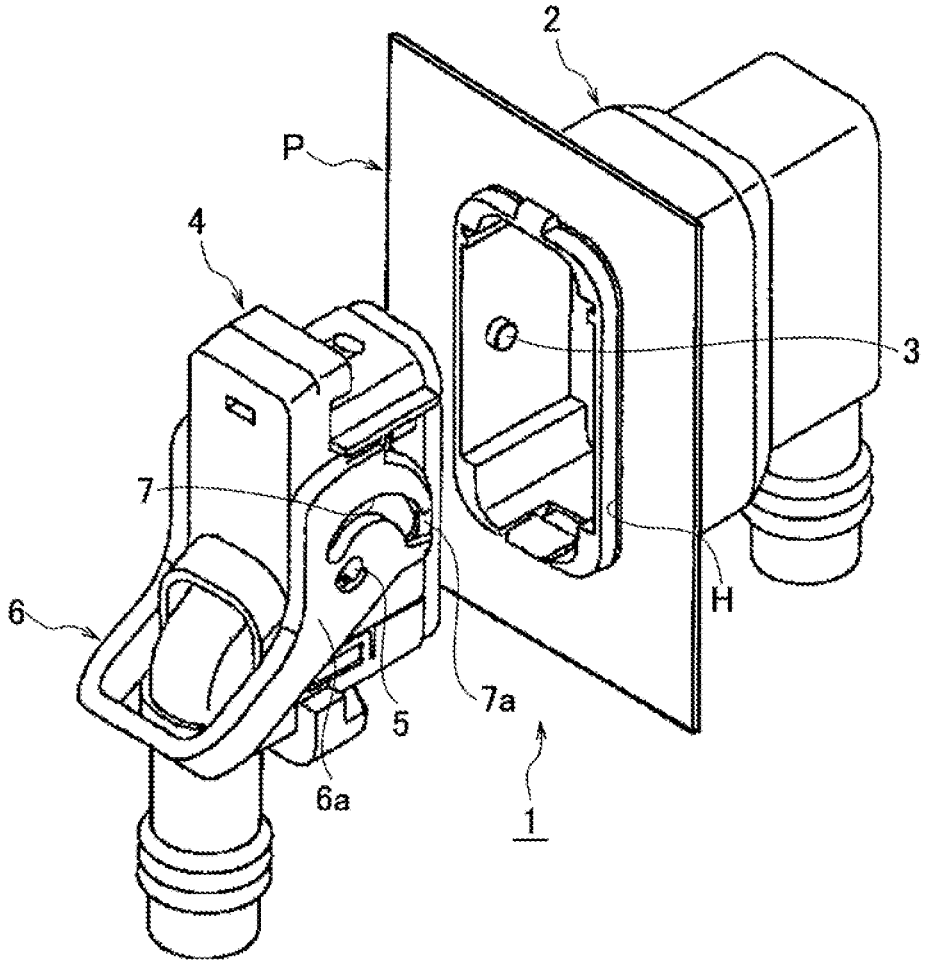
FIG. 22A is a perspective view illustrating a state before fitting of a lever-type connector according to a comparison example.

As illustrated in FIG. 22A, a lever-type connector 1 includes a male connector housing 2, a female connector housing 4 and a gate-shaped lever 6. The male connector housing 2 is arranged on an inside of a panel P of a door of an automobile. The female connector housing 4 is arranged on an outside of the panel P. The lever 6 is rotatably supported by the female connector housing 4 by way of a shafts 5, 5 of the female connector housing 4 (only one shaft portion 5 illustrated in FIG. 22A). A cam groove 7 in which a follower pin 3 formed on the male connector housing 2 can enter, is formed on each leg portion 6*a* of the lever 6. An inlet 7*a* of the cam groove 7 is formed so as to be directed toward a front side (a side which opposedly faces the male connector housing 2) in a state before the lever 6 is rotated. A reference sign "H" indicates a mounting opening for a panel P.

By rotatably manipulating the lever 6 in a state where each follower pin 3 is inserted into the inlet 7*a* of the cam groove 7 of the lever 6, the follower pin 3 is moved along the cam groove 7 and a fitting engagement operation between the male connector 2 and the female connector 4 is advanced.

In the lever-type connector 1, a temporary setting state of the male connector 2 and the female connector 4 is maintained by locking the follower pin 3 to the inlet 7*a* of the cam groove 7. It is necessary to release a temporary setting state at the time of performing an operation such as a repair of a vehicle. However, the follower pin 3 is locked perpendicular to the inlet 7*a* of the cam groove 7 and hence, there is a concern that a connector releasing force is increased so that a repair operation becomes difficult.

Figure 22B:
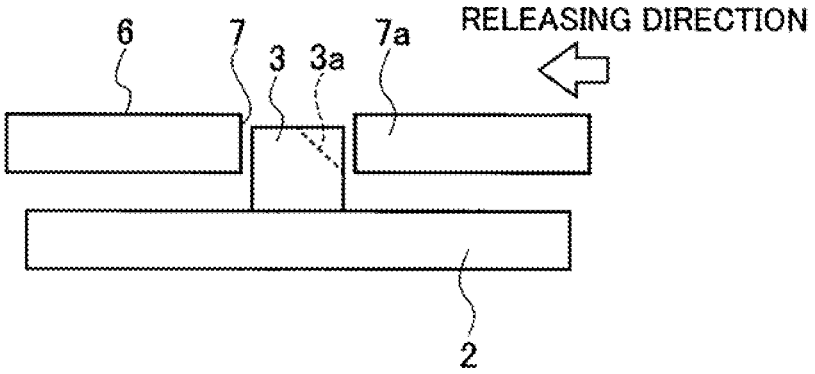
FIG. 22B is a schematic cross-sectional view illustrating a relationship between a follower pin and a cam groove of the lever-type connector according to the comparison example.

To enhance connector releasing property, for example, in the case where a tapered portion 3*a* is formed on the follower pin 3 by shaving the follower pin 3 as illustrated in FIG. 22B, a strength of the follower pin 3 is lowered. Accordingly, at the time of making the male connector 2 and the female connector 4 engage with each other by fitting, there is a concern that the follower pin 3 is removed from the cam groove 7 so that fitting engagement between the male connector and the female connector becomes poor.

According to this embodiment, the lever-type connector is assembled to the vehicle body panel after the male connector engages with the female connector by fitting. However, assembling of the lever-type connector is not limited to such a case. For example, the female connector may engage with the male connector by fitting after the female connector is assembled to the vehicle body panel.

According to this embodiment, the female connector is formed of the female housing and the frame, and the cam grooves are formed on the frame. However, the disclosure is not limited to such a case. For example, the female connector may be formed of only the female housing, and the cam grooves may be formed on the female housing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lever-type connector comprising:

a first connector;

a second connector; and a lever which is mounted on the first connector, and is configured to pull the first connector and the second connector to each other from a connector temporary set state so as to engage the first connector and the second connector with each other by fitting, due to a rotational manipulation of the lever from a lever rotation start position to a lever rotation completion position, wherein the first connector has a support shaft which forms a rotary shaft of the lever, the second connector has a cam groove for pulling in the first connector, and a temporary locking projection disposed at an inlet of the cam groove, the lever has a bearing portion which is rotatably supported on the support shaft, and a cam boss which engages with the cam groove, at the connector temporary set state, the first connector is configured to be prevented from moving in a connector removal direction where the first connector is removed from the second connector, by engaging the cam boss of the lever, which is positioned at the lever rotation start position, with the cam groove in a state where the cam boss is locked to the temporary locking projection, a projection is formed on an outer side of the cam boss in the connector removal direction; and the projection has a tapered portion which obliquely faces a surface of the temporary locking projection on a connector removal direction side.

2. The lever-type connector according to claim 1, wherein a position restricting rib which engages with a pull-in rib of the cam groove, is formed on an upper end of the cam boss.

3. The lever-type connector according to claim 1, wherein a guide projection is formed on a housing of the first connector, a guide groove which engages with the guide projection, is formed on the lever, and the lever is configured to slide relative to the housing after the guide projection slides in the guide groove and the first connector and the second connector engage with each other by fitting due to the rotational manipulation of the lever.

* * * * *